US005316188A

United States Patent [19]

Froehlich et al.

[11] Patent Number: 5,316,188

[45] Date of Patent: May 31, 1994

[54] APPARATUS FOR STRETCHING TUBULAR MATERIAL WITH A LEAST ONE CLOSED END ON A STRETCHER

[75] Inventors: Eckhard Froehlich, Steinheim; Peter Steiner, Goeppingen; Karl Hildebrandt, Weilheim/Teck, all of Fed. Rep. of Germany

[73] Assignee: August Krempel Sohne GmbH & Co., Fed. Rep. of Germany

[21] Appl. No.: 78,999

[22] Filed: Jun. 17, 1993

[30] Foreign Application Priority Data

Jun. 23, 1992 [DE] Fed. Rep. of Germany ..... 4220543

[51] Int. Cl.[5] ..... D06C 5/00; D06C 15/00

[52] U.S. Cl. ..... 223/77; 223/75; 223/60

[58] Field of Search ..... 223/75, 76, 77, 84, 223/60, 61, 63, 74

[56] References Cited

U.S. PATENT DOCUMENTS 1,948,225 2/1934 Myers et al. ..... 223/76
2,023,946 12/1935 Ammou ..... 223/77
4,434,918 3/1984 Hodges ..... 223/75
4,550,868 11/1985 Hodges et al. ..... 223/75

FOREIGN PATENT DOCUMENTS 2302758 6/1976 Fed. Rep. of Germany .
2081321 2/1982 United Kingdom ..... 223/75

*Primary Examiner*—Clifford D. Crowder
*Assistant Examiner*—Bibhu Mohanty
*Attorney, Agent, or Firm*—Harness, Dickey & Pierce

[57] ABSTRACT

An apparatus for stretching tubular material with at least one closed end on a stretcher, in particular for stretching stockings, pantyhose, and the like on an elongated stretcher, is described, in which the tubular material is pulled onto the stretcher by means of belt drives. Each stretcher has at its lower end an end member at which there is provided a sensing device by means of which the belt drives are shut off as soon as the closed end of the tubular material arrives in the region of the end member. With the sensing device, the belt drives are reliably shut off regardless of the length of the tubular material being pulled on, which not only prevents slippage of the drive rollers of the belt drives, but also ensures complete pulling onto the stretcher.

12 Claims, 2 Drawing Sheets

Figure 1:
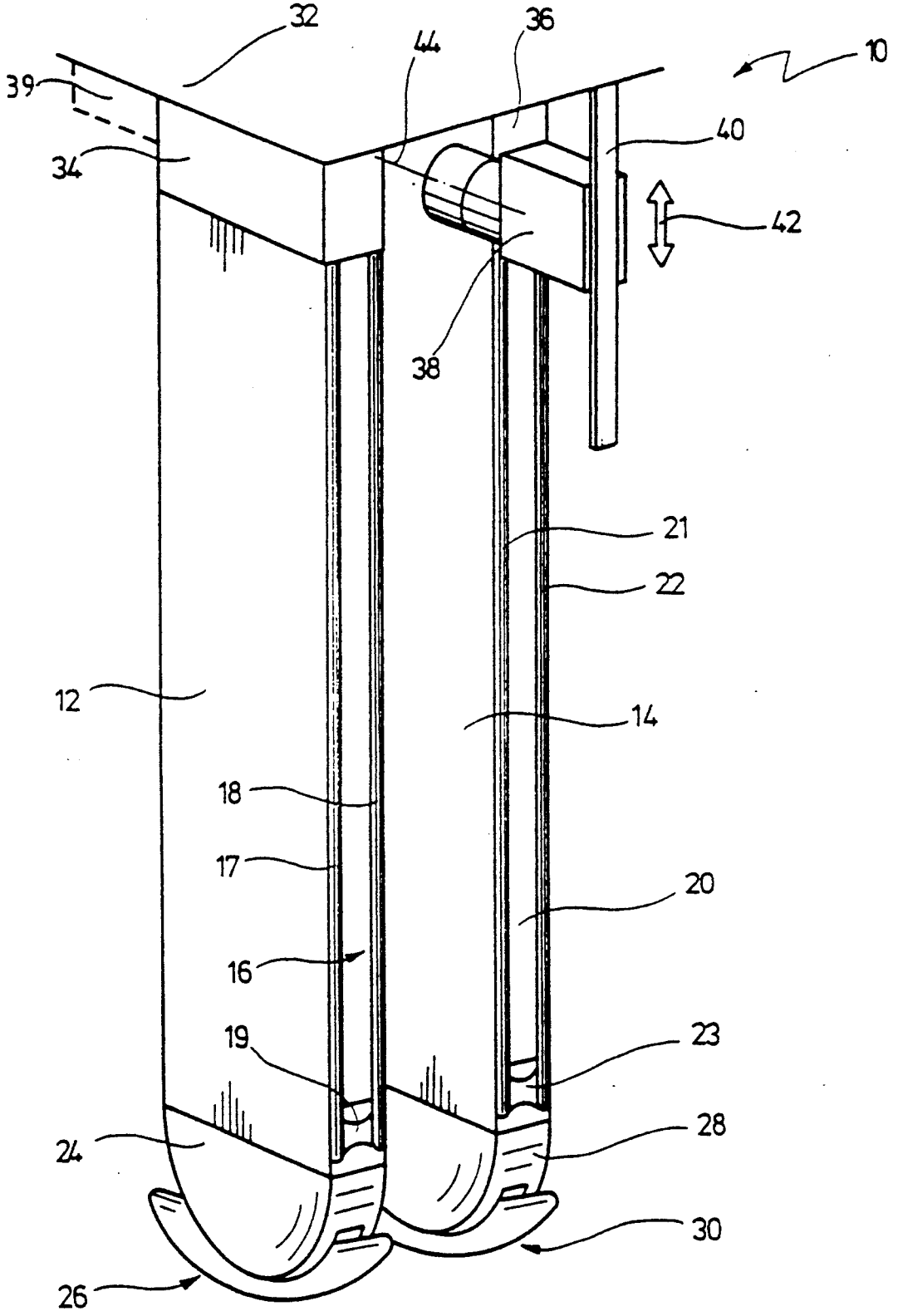

APPARATUS FOR STRETCHING TUBULAR MATERIAL WITH A LEAST ONE CLOSED END ON A STRETCHER

The invention concerns an apparatus for stretching tubular material with at least one closed end on a stretcher, in particular for stretching stockings, pantyhose, and the like on an elongated stretcher, with at least one belt drive that has at least one belt segment arranged on the rim of the elongated stretcher to pull the material onto the stretcher, and with a shutoff means to shut off the belt drive.

When they are manufactured, women's stockings undergo a dyeing process in which shrinkage of the fabric can occur, and that at least occasionally results in the fabric sticking together, so that the stockings become crumpled together.

In order to bring the stockings into a smooth condition suitable for the purchaser, they must therefore first be pulled onto a stretcher and, if applicable, additionally subjected to a heat treatment on the stretcher in order to relax the stockings.

German patent 2,302,758 has disclosed a pull-on stretcher for stockings or pantyhose which consists substantially of an elongated flat rail, and in which belt drives with endless belts, each circulating in opposite directions and guided by belt pulleys lying inside the rail contour, are provided on both long sides of the rail.

With the known apparatus, stockings, pantyhose, and the like can be semi-automatically pulled onto a stretcher. The belt drives considerably facilitate and accelerate the pulling-on process. As soon as a stocking has been pulled on, power to the belt drives must be shut off; in the known device, a photocell can be provided for this purpose at the upper end of the pull-on stretcher. The photocell generates a switching pulse as soon as a stocking pulled onto the stretcher interrupts a light beam provided at the upper end of the pull-on stretcher, which shuts off the belt drives.

It has been found to be disadvantageous in this context that the photocell must be set in each case in accordance with the length of the stockings or pantyhose being pulled on; an optimum setting is almost impossible, since even stockings of a single ready-to-wear size can exhibit production-related fluctuations in length. If the photoelectric barrier is set at too great a distance from the end member of the stretcher over which the stocking is to be pulled, it can happen, especially with somewhat shorter stockings, that the photo-electric barrier does not generate any shutoff signal at all, so that the belt drives continue to run until the foot part of the stocking is completely in contact with the end member of the stretcher. Friction between the stocking and the belt drives is so great that at this stage further movement of the belt drives is no longer possible, and the drive rollers of the belt drives slip. This generates a great deal of frictional heat in the region of the drive rollers, which results in rapid wear of the plastic belts. If, on the other hand, the photoelectric barrier is set at too short a distance from the end member of the stretcher, longer stockings are then not completely pulled onto the stretcher, since the photoelectric barrier causes premature shutoff, with the result that the stockings are not completely smoothed in the foot region. This represents a particular problem when pantyhose are being pulled onto two parallel stretchers, since the two legs may be slightly different in length, so that even if the belt drive shutoff time is optimum for one leg, slippage of the belt drives is already occurring at the other leg, or conversely the belt drives are shut off prematurely, so that the leg is not completely stretched in the foot region.

The underlying object of the invention is to create an apparatus for stretching tubular material with at least one closed end on a stretcher, in particular for stretching stockings, pantyhose, and the like on an elongated stretcher, with which the disadvantages of the prior art are eliminated and stretching of the tubular material on the stretcher is optimized.

This object is achieved, according to the invention, by the fact that in an apparatus of the aforesaid kind, the shutoff means has a sensing means associated with one end member of the stretcher, by means of which the belt drive is shut off as soon as the closed end of the tubular material reaches the region of the end member.

In this manner, the belt drive is always shut off when the closed end of the tubular material, namely in particular the foot part of a stocking or pair of pantyhose, has been completely pulled onto the end member, and the sensing means thus generates a shutoff signal to shut off the belt drive. As a result, regardless of the length of a stocking leg, not only is complete stretching of the stocking on the stretcher guaranteed, but slippage of the drive rollers of the belt drive is also reliably prevented, even if the stockings are too long.

A further advantage of the arrangement according to the invention consists in the fact that even if the apparatus is used to stretch stockings or pantyhose of different ready-to-wear sizes in succession, no resetting of the sensing device is necessary; results in a considerable simplification of the operating procedure. Moreover, stockings of different lengths, socks, pantyhose, and the like can be pulled on in any desired sequence without requiring any kind of adjustment actions, since each stretcher has its own sensing device to shut off the belt drive.

In an advantageous development of the invention, the sensing device has a displaceable, spring-loaded feeler element that projects at least partly out of the end member. Although sensing could also theoretically be done optically, in other words for example by means of a photoelectric barrier, this method allows for particularly simple and reliable shutoff.

Specifically, the belt drive is shut off, regardless of the shape of the foot part, whenever the closed end of the tubular material contacts the feeler element and the stress exerted on the feeler element as a result of the elongation of the material is sufficient to overcome the spring force of the feeler element.

In an advantageous development of the invention, the feeler element is configured as a part shaped substantially like a segment of a circle, which is guided in a slot of the end member in a movable and spring-loaded fashion.

Since in this manner at least a portion of the outer surface of the feeler element, shaped like a segment of a circle, projects beyond the end member, good adaptation to the shape of the foot part of a stocking is guaranteed, so that on the one hand damage to the stocking is ruled out, and on the other hand reliable activation is achieved. Moreover, it would also be possible to configure the feeler element in the shape of a substantially cylindrical feeler, resulting in especially simple manufacture.

In a further advantageous embodiment of the invention, a microswitch or a contactless sensor element is actuated by the feeler element.

While a mechanical switch in the form of a microswitch represents a particularly economical solution, it is advantageous, especially if the stretcher is to be heatable, to use a contactless sensor element that is actuated by the feeler element. This ensures reliable shutoff of the belt drive even at high temperatures.

An additional development of the invention provides for the microswitch or the contactless sensor element to be connected to a fiber optic cable.

This makes it possible, for example, to provide an optical sensor element that is activated and evaluated via a fiber optic cable. Particularly reliable and temperature-resistant sensing can be achieved in this manner.

In a further embodiment of the invention, two stretchers arranged substantially parallel are each provided with an end member, associated with each of which is a sensing means.

An arrangement of this kind is especially suitable for stretching pantyhose. Similarly, such an arrangement can also be used to stretch individual stockings simultaneously.

If pantyhose are to be pulled on with such an arrangement, it is advantageous to provide a second sensing means for the second stretcher and a third shared sensing means at the opposite end of the stretcher that responds when the waist-band of the pantyhose has been pulled on as far as the third sensing means.

This makes it possible, using a single third sensing means, to prevent the pantyhose from exceeding the allowable maximum size after they are later folded together, even in the case of products that have turned out to be particularly large.

If, on the other hand, individual stockings are to be pulled onto the two stretchers, it is advantageous to associate a third and a fourth sensing means with each of the two stretchers at the end facing away from the end member.

Once the stockings, pantyhose, or the like have been pulled onto the stretcher or stretchers, each belt drive preferably remains initially deactivated for a time after being shut off, and is then driven in the opposite direction in order to pull the stockings or pantyhose back off their stretchers.

Although leaving the stockings or pantyhose on the stretcher for a certain period itself produces a certain relaxation of the fabric, in a preferred development each stretcher can be heated, which allows for particularly good smoothing of the fabric.

For this purpose, heating elements can, for example, be arranged inside the stretcher. In addition, the stretcher can also be heated from outside with a blower, an infrared radiator, or the like.

When a third or fourth sensing means is provided at the end opposite the end member of the stretcher or stretchers the belt drive can be shut off by means not only of the first or second sensing means but also of the third or fourth sensing means. It has been found in the case of long stocking sizes, due to the complete stretching that is caused by complete pulling onto the stretcher, that with certain stockings that have turned out to be especially long, in particular women's stockings and pantyhose, the maximum allowable length is exceeded when they are folded together, so that when folded up, the stocking or pantyhose will no longer fit in the package provided.

To prevent this, according to the invention the third and possibly fourth sensing means, adjustable in the lengthwise direction of the stretcher, is provided at the opposite end of the stretcher in addition to the first or second sensing means associated with the end member or members of the stretcher or stretchers. Preferably the third sensing device is set so that shutoff is activated in principle by the first or second sensing means, and the third or fourth sensing means respond only if especially long stockings, just at the upper limit of allowable length, are being stretched, to allow the stockings to be inserted into the package after they have first been suitably folded. If the third or fourth sensing means respond before the first or second sensing means have responded, the result is that one stocking leg is not completely stretched at the foot end and therefore remains overall somewhat shorter than would be the case with complete stretching on the stretcher. This ensures that after having been folded, a stocking or pantyhose does not exceed the defined maximum size, to allow insertion into the package under all circumstances. This prevents the occurrence of rejects, and the incomplete smoothing in the foot region can be accepted.

Preferably the first and third sensing means are coupled to one another in such a way that the belt drive is shut off upon activation of either the first or the third sensing means, or both sensing means. In a preferred development, the third sensing means is an optical sensing device, in particular a photoelectric barrier.

This results in particularly simple and economical sensing.

It is understood that the features mentioned above and those yet to be explained below can be used not only in the respective combinations indicated, but also in other combinations or in isolation, without leaving the context of the present invention.

An exemplary embodiment of the invention is depicted in the drawings and is explained in more detail in the description below. In the drawings, FIG. 1 shows a simplified perspective depiction of an apparatus according to the invention; and FIG. 2 shows an enlarged view of an end member of a stretcher according to FIG. 1.

Figure 2:
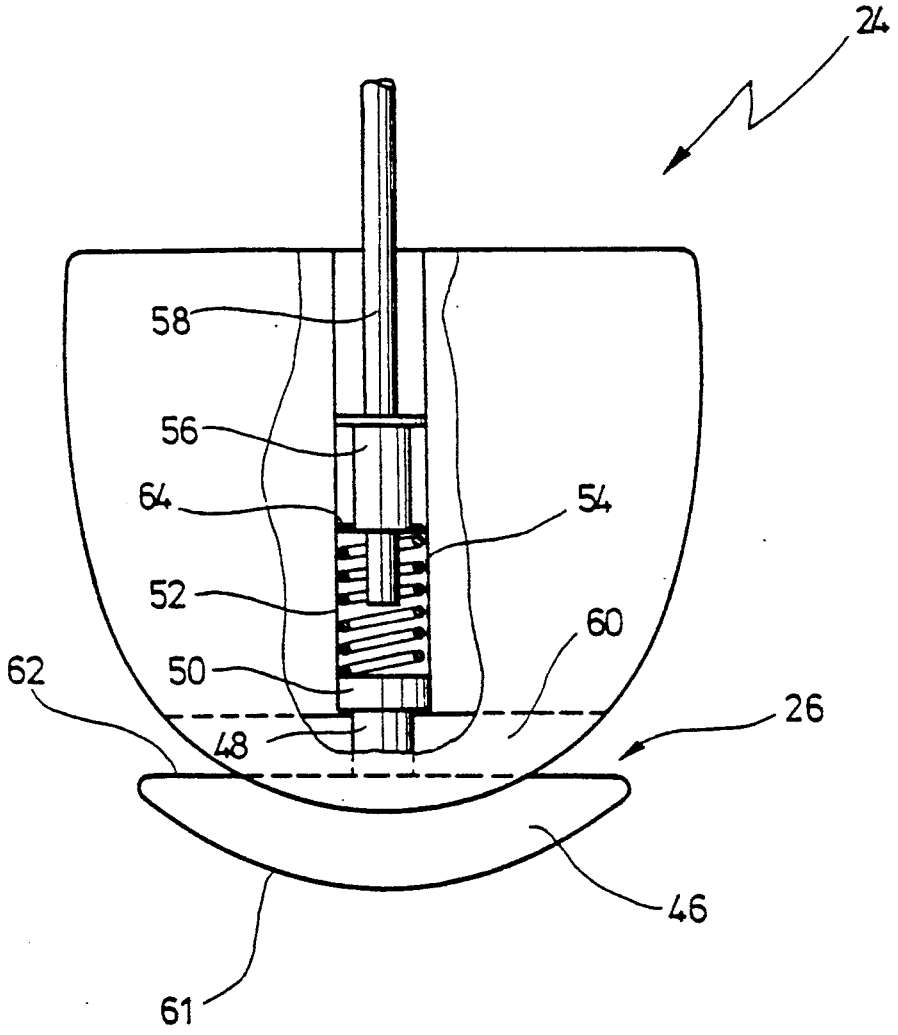

An apparatus according to the invention is designated in its entirety with the number 10 in FIG. 1.

Two flat, elongated, vertical stretchers 12, 14 are attached next to one another, each by means of an upper terminating member 34, 36, on the underside of a machine frame 32 (only schematically indicated).

The wide long sides of the stretchers are closed off on the outside by elongated panels, each joined at its upper end to the upper terminating member 34, 36, and at its lower end to an end member 24, 28 that is rounded at the bottom. Provided in each stretcher 12, 14 are two double belt drives 16, 20, the belt segments 17, 18 and 21, 22 of which project slightly outwardly from the edge of the narrow end surfaces of the stretchers.

In FIG. 1, for each stretcher 12, 14 only one double belt drive 16 and 20 is visible, the belt segments 17, 18 and 21, 22 of which project slightly outwardly over the rim of the end surfaces of the stretchers 12, 14. The double belt drives 16 and 20 are guided by double rollers 19 and 23 at the lower end of the stretchers 12 and 14, and by corresponding double rollers at the upper end of the stretchers, which are arranged inside the upper terminating members 34 and 36 and are driven by a motor (not depicted). Corresponding double belt drives are arranged on the opposite end sides of the stretchers 12, 14. The belts are made of plastic, which is preferably heat-resistant. The configuration of the stretchers and the belt drives is known in the art, and is described further in German patent 2,302,758.

Each stretcher 12, 14 is closed off at the lower end by the end member 24, 28, which has an approximately semicircular shape and is rounded off at its outer edges.

Associated with each of the end members 24, 28 is a switching means 26, 30 including a sensing means, by means of which the belt drives 16, 20 of each stretcher can be shut off, and which will be explained in more detail below with reference to FIG. 2.

The two stretchers 12, 14 are arranged with their long sides parallel to one another, so that pantyhose can be pulled onto them. Secured to the underside of the machine frame 32 is a vertical holder 40 onto which a third switching means 38 in the form of a photoelectric barrier is fastened in a vertically movable manner, as indicated by the arrow 42. The photoelectric barrier 38 is arranged between the two stretchers 12, 14 so that the light beam indicated by the number 44, extends approximately parallel between the two stretchers 12, 14. In FIG. 1 only the receiver of the photoelectric barrier is depicted, while the transmitter is arranged correspondingly, in a vertically adjustable manner, on the opposite side.

The two stretchers 12, 14 furthermore have heating rods with which heating can be applied in order to allow rapid and complete smoothing of stockings pulled onto the stretchers.

The configuration of the end members and the sensing means is evident in more detail from FIG. 2.

The end member depicted in FIG. 2, which is designated in its entirety with the number 24, has a flat, approximately semicircular basic shape and is rounded at its external sides so that stockings can be more easily pulled on. Provided at the lower end of the end member 24 is a slot 60 inside which a feeler element 46, shaped substantially like a segment of a circle, is displaceably guided, with its rounded part 61 projecting out from the end member 24. The feeler element 46 ends at an upper straight end surface 62 and is connected by means of a central pin 48 to a flat cylindrical plate 50 which can move in a central cylindrical recess 52 of the end member 24. The plate 50 is acted upon by a spring element 54 in the form of a helical spring that is braced against a shoulder 64 opposite. An optical sensor element 56, which is connected to a fiber optic cable 58 that is guided upward out of the end member 24, is also fastened in the cylindrical recess 52. The sensor element 56 can sense, in a contactless manner, a movement of the plate 50 which occurs when the spring force is overcome as a result of pressure exerted on the rounded part 61 of the feeler element 46.

The apparatus operates as follows:

If, for example, a pair of pantyhose is to be stretched on the two stretchers 12, 14, the stocking portion thereof is first pulled onto the lower end of the stretchers 12, 14 over the two end members 24, 28 until the ascending belt segments 17, 18 and 21, 22 of the belt drives 16, 20 automatically pick up the pantyhose and pull them completely onto the two stretchers 12, 14 until the two foot parts reach the region of the end members 24, 28 and the feeler elements of the switching means 26, 30 are compressed against the spring pressure and the sensor elements 56 each generate a shutoff pulse which shuts off the belt drives 16, 20. The upper switching means, configured as a vertically adjustable photoelectric barrier 38, is set in such a way that a switching pulse is generated only with the largest ready-to-wear size that is being processed, and even then only upon reaching the allowable maximum length of a pair of pantyhose, which will still allow it to be placed in the intended package after folding.

The lower switching means 26, 30 and the upper switching means, configured as a photoelectric barrier 38, are connected by means of a logical OR circuit in such a way that the belt drives of each stretcher 12 or 14 are shut off if either the lower switching means 26 or 30 or the upper switching means 38 issues a switching pulse.

In an alternative embodiment, it is possible to assign one sensing means to each of the two stretchers 12, 14 at the upper end, if, for example, individual stockings rather than pantyhose are to be pulled on. A possible fourth sensing means at the upper end is indicated by dashed lines 39.

After individual stockings or a pair of pantyhose have been completely pulled onto the two stretchers 12, 14, and after the belt drives have been shut off, the latter remain deactivated for a few seconds to allow relaxation and smoothing of the pantyhose or stockings while the heating system on the stretchers is switched on.

Then the belt drives are driven in the opposite direction by means of a time controller circuit, so that the pantyhose or stockings can be pulled back off the stretchers.

What is claimed is:

1. Apparatus for stretching tubular material with at least one closed end, said apparatus comprising:

at least a first belt drive connected substantially in an axial direction to a first elongated stretcher and having at least one belt segment projecting laterally over said elongated stretcher for pulling said material onto said stretcher;

a first end member connected at a first end of said first elongated stretcher;

at least a first switching means including a first sensing means arranged on said first end member which is coupled to said first belt drive for switching off said first belt drive when sensing that said closed end of said material reaches said first end member.

2. Apparatus according to claim 1, wherein said first sensing means comprises a first feeler element arranged displaceably within said end member and being biased by a biasing element to project at least partly out of said end member.

3. Apparatus according to claim 2, wherein said feeler element comprises a part shaped substantially like a segment of a circle and arranged displaceably within a slot provided within said end member, and wherein said biasing element comprises a spring element spring-biasing said feeler element to project at least partly out of said end member.

4. Apparatus according to claim 2, wherein said switching means comprises a microswitch or a contactless sensor element actuated by said feeler element.

5. Apparatus according to claim 4, wherein said microswitch or said contactless sensor is connected to a fiber optic cable.

6. Apparatus according to claim 1, wherein said material comprises a first and a second closed end, said apparatus further comprising:

a second elongated stretcher arranged substantially parallel to said first elongated stretcher and having a second belt drive including at least one belt segment projecting laterally over said second elongated stretcher for pulling said material onto said stretcher;

a second end member arranged at a first end of said second elongated stretcher;

a second switching means including a second sensing means arranged on said second end member which is coupled to said second belt drive for switching off said second belt drive when sensing that said second closed end reaches said second end member.

7. Apparatus according to claim 6, wherein said apparatus further comprises a third switching means including a third sensing means which is arranged at a second end of said first elongated stretcher opposite said first end which is adjustable along an axial direction of said first elongated stretcher and which is coupled to said first belt drive for shutting off said first belt drive when sensing that said material reaches said third sensing means.

8. Apparatus according to claim 7, wherein said second sensing means comprises a photoelectric barrier.

9. Apparatus according to claim 7, wherein said first and third switching means are coupled to one another to shut off said first belt drive upon activation of either the first or the second sensing means or upon activation of both sensing means.

10. Apparatus according to claim 6, wherein said apparatus further comprises a third switching means having a third sensing means which is arranged at a second end of said first elongated stretcher opposite said first end which is adjustable in parallel to an axial direction of said first elongated stretcher and which is coupled to said first or said second belt drives for shutting off said first or said second belt drives when said material reaches said third sensing means.

11. Apparatus according to claim 10, wherein said third switching means is coupled to said first and second belt drives for shutting off both belt drives when sensing that said material reaches said third sensing means.

12. Apparatus according to claim 10, wherein said third switching means is coupled to said first belt drive for shutting off said first belt drive when said material reaches said second end of said first elongated stretcher, said apparatus further comprising a fourth switching means having a fourth sensing means which is arranged at said second end of said second elongated stretcher opposite said first end which is adjustable in parallel to an axial direction of said second elongated stretcher and which is coupled to said second belt drive for shutting off said belt drive when sensing that said material reaches said fourth sensing means.

* * * * *